United States Patent [19]

Schiek

[11] 4,317,655

[45] Mar. 2, 1982

[54] MARINE DRIVE GEAR HOUSING

[75] Inventor: James M. Schiek, Omro, Wis.

[73] Assignee: Brunswick Corporation, Skokie, Ill.

[21] Appl. No.: 94,739

[22] Filed: Nov. 15, 1979

[51] Int. Cl.[3] ..... B63H 1/14; B63H 1/28

[52] U.S. Cl. ..... 440/78; 440/49; 74/606 R; 308/DIG. 12

[58] Field of Search ..... 115/49, 900, 75-78; 74/606; 308/DIG. 12

[56] References Cited

U.S. PATENT DOCUMENTS

| | | | |
|---|---|---|---|
| 1,511,868 | 10/1924 | Asbury | 440/78 X |
| 2,549,484 | 4/1951 | Kiekhaefer | 440/78 |
| 2,630,775 | 3/1953 | Kiekhaefer | 440/75 |
| 3,587,510 | 6/1971 | Shimanckas | 440/78 X |

*Primary Examiner*—Charles A. Marmor

*Attorney, Agent, or Firm*—Andrus, Sceales, Starke & Sawall

[57] ABSTRACT

A marine propulsion unit lower gear housing permits disassembly by rearranging easily removable parts for engagement with non-easily removable parts thereby permitting the use of standard wrenches for disassembly and assembly.

10 Claims, 5 Drawing Figures

MARINE DRIVE GEAR HOUSING

DESCRIPTION

1. Technical Field

A marine propulsion unit such as an outboard engine or stern drive includes a lower gear housing having a propeller shaft and foward and reverse gears. The gears are retained in position by a closure member which is threaded into the gear housing. This closure member must be removed for inspection and replacement of the gears and other associated internal parts. Previously the closure member was removed with a wrench which engages the closure member. This wrench is a special tool which is generally only available at certain repair facilities. Therefore without the special wrench, removal of the closure member by the operator and removal at remote locations is generally not possible or very difficult.

2. Disclosure of Invention

The novel marine drive includes a gear housing having a propeller shaft and gear means positioned on the propeller shaft to rotate the shaft. A closure member is positioned on the propeller shaft and threadably engaged with the gear housing, a propeller is fixed on the propeller shaft for rotation thereby, and a thrust carrying member is positioned between the propeller and the propeller shaft for transmitting the propeller thrust to the propeller shaft. The thrust carrying member and the closure member each have spaced mating engagement means and upon axial engaging movement of the mating engagement means the thrust carrying member will rotate to remove the closure member. This permits easy removal of the gearing in the lower drive unit at repair shops and at remote locations with the use of standard wrenches such as the well-known crescent wrench.

BEST MODE FOR CARRYING OUT THE INVENTION

Figure 1:
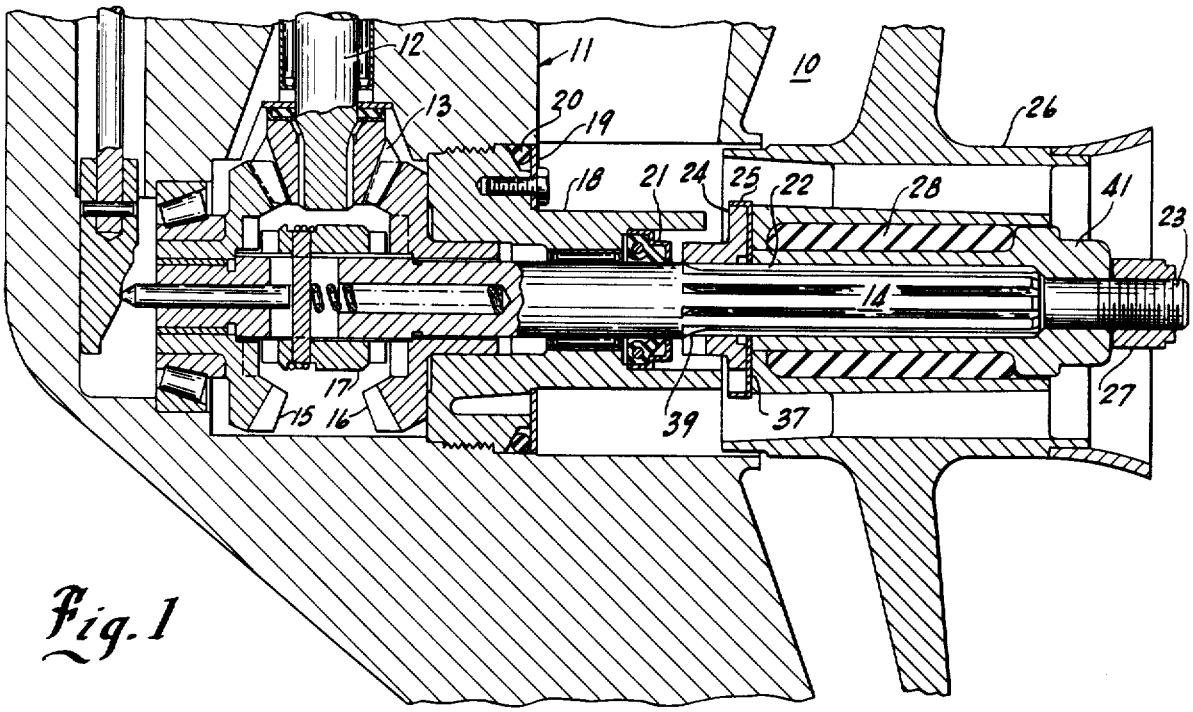
FIG. 1 is a cross-sectional view of a lower gear housing of a marine drive illustrating the invention.

FIG. 1 illustrates a marine propulsion unit 10 having a lower gear housing 11. The gear housing 11 includes a drive shaft 12 having a pinion gear 13 and a propeller shaft 14. The propeller shaft 14 includes forward and reverse bevel gears 15 and 16 respectively which continuously engage the pinoin gear 13 and a sliding clutch 17 which engages between clutch faces on each of the bevel gears 15 and 16 by sliding on a spline on the propeller shaft 14 thereby providing forward and reverse rotation of the propeller shaft 14.

A retaining member or closure member 18 is positioned over the propeller shaft 14. The closure member 18 supports the propeller shaft 14 and positions the reverse bevel gear 16. Retaining washer 19 retains O-ring 20 between closure member 18 and gear housing 11 to seal the gear housing 11 against entry of water and to retain lubricant. A separate seal 21 between the propeller shaft 14 and the closure member 18 also prevents water entry and retains lubricant.

The propeller shaft 14 includes a splined portion 22 and a threaded end portion 23. An intermediate member or thrust carrying member 24, a cup washer 25, and a propeller 26 are positioned on the splined portion 22 of the propeller shaft 14 and held thereon by a propeller nut 27 engaging the threaded end portion 23. The propeller 26 includes a rubber shock hub 28.

The thrust carrying member 24 includes a first portion 29 which has a flat radial surface 30 and a second portion 31 which has a thrust transferring end surface 32. The first portion 29 includes engagement means **33*a* which engage with mating engagement means 33*b* on the closure member 18. In the preferred embodiment the engagement means 33*a* are indentations 34 formed in the first portion 29 of the thrust carrying member 24 and the mating engagement means 33*b* are projections 35 formed in the closure member 18. The projections 35 may be on either the thrust carrying member 24 or the closure member 18 with the indentations 34** on the other member. Other keying means may also be used to provide the mating engagement means.

In the preferred embodiment the cup washer 25 fits over the first portion 29 of the thrust carrying member 24 to cover the indentations 34 during normal operation. The cup washer 25 provides a wear surface 37 between the thrust carrying member 24 and the propeller 26. The wear surface 37 permits relative motion of the propeller 26 on the rubber shock hub 28. The cup washer 25 need not be used since the thrust carrying member 24 can also provide the wear surface 37 but is generally used to permit replacement of a low cost washer 25 rather than a higher cost thrust carrying member 24.

In the preferred embodiment the inner diameter of the thrust carrying member 24 includes a spline 38 which mates with the splined portion 22 of the propeller shaft 14. The spline 38 includes a formed surface 39 at the thrust transferring end which mates with an end formed surface 40 on the splined portion 22 of the propeller shaft 14 to transfer the thrust load from the propeller 26 into the propeller shaft 14. The propeller 26 includes wrench engaging surfaces 41 for receiving a torque applying tool.

Figure 2:
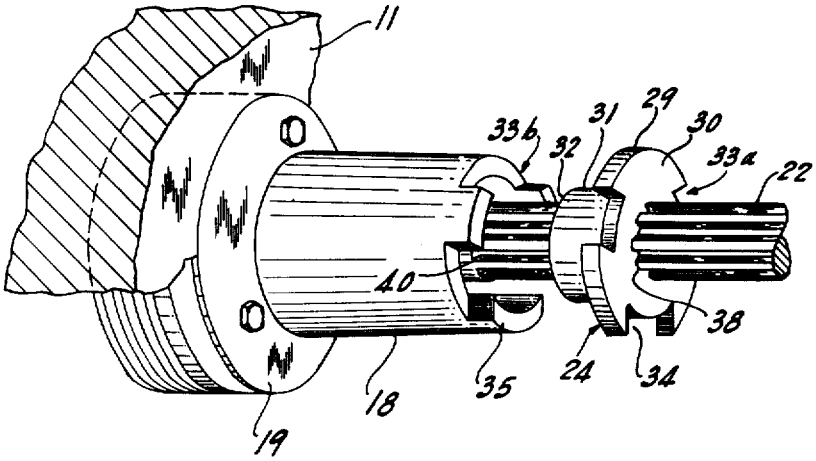
FIG. 2 is a perspective view of a portion of the gear housing shown in FIG. 1.
Figure 3:
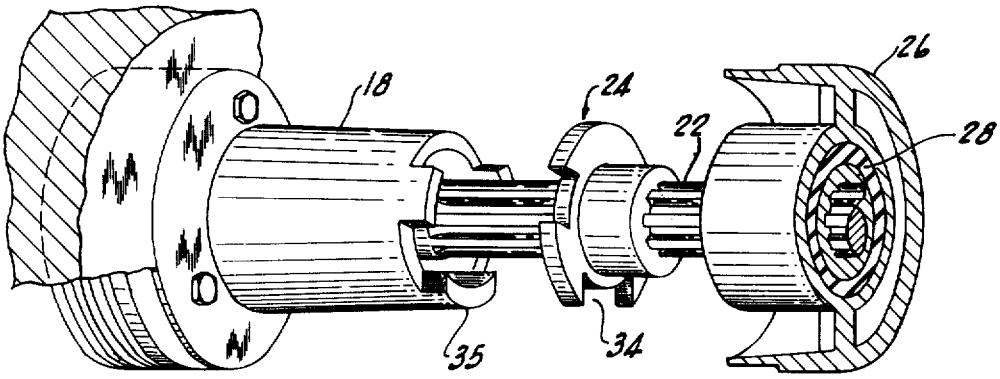
FIG. 3 is the same as FIG. 2 illustrating the use of the thrust carrying member and propeller for removal of the closure member.

FIG. 1 and 2 illustrate the thrust carrying member 24 in the normal operating position of the marine propulsion unit 10. In the normal operating position the engagement means **33*a* and the mating engagement means 33*b* are not engaged. In this position the thrust from the propeller 26 is first carried to the cup washer 25, then, to the thrust carrying member 24 and then from the thrust carrying member 24 to the propeller shaft 14. The axial position of the thrust carrying member 24 on the propeller shaft 14 prevents engagement of the engagement means 33*a* and mating engagement means 33*b***.

Figure 4:
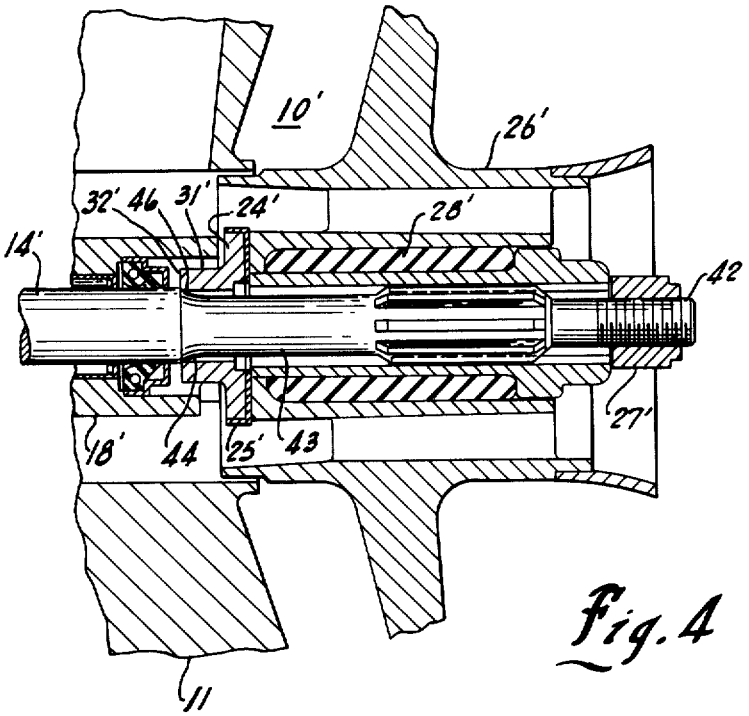
FIG. 4 is an alternative embodiment similar to FIG. 1.
Figure 5:
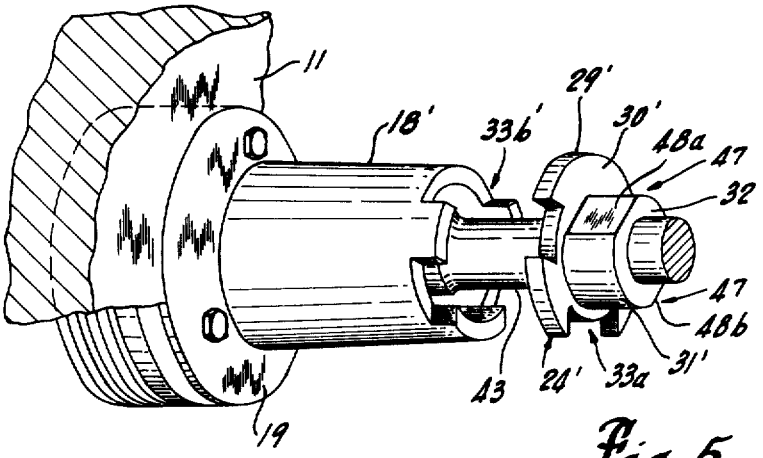
FIG. 5 is a perspective view similar to FIG. 3.

FIG. 4 illustrates an alternative marine propulsion unit 10'. In this embodiment the propeller shaft 14' includes a threaded end portion 42 and a necked-down portion 43 ending in a fillet or shoulder 44. The thrust carrying member 24' similarly includes a first portion 29' which has a flat radial surface 30' and a second portion 31' which has a thrust transferring end surface 32'. The inside diameter of the thrust carrying member 24' at the end surface 32' has an edge radius 46 which contacts against the fillet or shoulder 44 to carry the thrust load from the propeller 26'. The first portion 29' includes engagement means 33a' which engage with mating engagement means 33b' on the closure member 18'. The second portion 31' also includes wrench engaging surfaces 47. The wrench engaging surfaces 47 are at least two parallel flat surfaces 48a and 48b. Multiple flat surfaces 48a and 48b also generate a hexagonal or other multiple-sided geometric shape suitable for engagement by a socket or box end wrench.

Removal of Closure Member

In the preferred embodiment the propeller 26 is used to remove the closure member 18. First, the propeller nut 27, propeller 26, cup washer 25, and thrust carrying member 24 are removed. Then, the thrust carrying member 24 without the cup washer 25 is reversed and repositioned over the propeller shaft 14 such that the engagement means 33a and mating engagement means 33b are engaged and the spline 38 mates with the splined portion 22 of the propeller shaft 14. The propeller 26 is then repositioned over the splined portion 22 to engage the splined portion 22. The propeller 26 is then either manually rotated or rotated with a wrench on its wrench engaging surfaces 41 to remove the closure member 18.

In the alternative embodiment the thrust carrying member 24' is used to remove the closure member 18'. The propeller nut 27', propeller 26', cup washer 25' and thrust carrying member 24' are removed as in the preferred embodiment. The thrust carrying member 24' without the cup washer 25' is reversed and repositioned over the propeller shaft 14' such that the engagement means 33a' and mating engagement means 33b' are engaged. A wrench is then applied to the wrench engaging surfaces 47 of the thrust carrying member 24' to rotate the thrust carrying member 24' to remove the closure member 18'. In the alternative embodiment it is not necessary that the closure member removal force be carried from the spline on the propeller shaft since the thrust carrying member 24' is used to directly remove the closure member 18'.

Although reversal of the thrust carrying member to obtain removal engagement with the closure member has been described a spacer may also be positioned between the closure member and the thrust carrying member to provide non-engagement of the engagement means on the closure member and mating engagement means on the thrust carrying member. The removal of the spacer will permit engagement. Under this alternative the wrench engaging surfaces on the thrust carrying member are positioned towards the propeller. To remove the closure member the spacer is removed, the engagement means and mating engagement means are engaged and the closure member is removed as described in the preferred or alternative embodiment.

I claim:

1. A marine drive including (A) a gear housing having a propeller shaft, (B) gear means positioned on said shaft for rotation thereof, (C) a closure member positioned on said shaft and threadably engaged with said gear housing, and (D) a propeller fixed on said propeller shaft for rotation thereby, wherein the improvement comprises:

an intermediate member positioned on said propeller shaft between said propeller and said closure member, said intermediate member and said closure member each having mating engagement means, said intermediate member having a first position in which said mating engagement means are spaced and do not engage and a second position in which said mating engagement means are engaged so that rotation of said intermediate member rotates said closure member for removal.

2. The marine drive defined in claim 1 wherein said intermediate member is axially movable between said first and second positions so as to provide axial engagement and disengagement of said mating engagement means.

3. The marine drive defined in claim 2 wherein said intermediate member comprises a thrust carrying member positionable on said propeller shaft for transmitting propeller thrust from said propeller to said propeller shaft.

4. The marine drive defined in claim 2 wherein said axial movement between said first and second positions is obtained by reversing said intermediate member on said propeller shaft.

5. The marine drive defined in claim 4 wherein said intermediate member includes surfaces for receiving a torque applying tool to rotate said intermediate member when said mating engagement means are engaged.

6. The marine drive as defined in claim 5 wherein said surface include at least two parallel flat surfaces for receiving a wrench.

7. The marine drive as defined in claim 5 wherein said surfaces include a socket wrench engaging shape for receiving a socket wrench.

8. The marine drive defined in claim 4 wherein said intermediate member is fixed for rotation on said propeller shaft when said engagement means are engaged whereby rotation of said propeller shaft will rotate said intermediate member and remove said closure member.

9. The marine drive defined in claim 8 wherein said propeller includes surfaces for receiving a torque applying tool to rotate said propeller.

10. The marine drive defined in claim 1 wherein said engagement means comprise mating projections and depressions on said intermediate member and said closure member.

* * * * *